United States Patent [19]

Hagemeister et al.

[11] Patent Number: 4,597,436

[45] Date of Patent: Jul. 1, 1986

[54] TUBULAR DISTRIBUTOR ARRANGEMENT FOR A HEAT COLLECTOR VESSEL

[76] Inventors: Klaus Hagemeister, Manzostrasse 28B, D-8000 Munich 50; Alfred Hueber, Nebelhornstrasse 4, D-8901 Merching, both of Fed. Rep. of Germany

[21] Appl. No.: 551,725

[22] Filed: Nov. 15, 1983

[30] Foreign Application Priority Data

Nov. 19, 1982 [DE] Fed. Rep. of Germany ..... 3242844
Mar. 19, 1983 [DE] Fed. Rep. of Germany ..... 3310061

[51] Int. Cl.[4] ..... F28F 7/00; F28F 9/02

[52] U.S. Cl. ..... 165/76; 165/173; 29/157.4

[58] Field of Search ..... 165/173, 172, 158, 76, 165/176, 175; 29/157.4

[56] References Cited

U.S. PATENT DOCUMENTS

| | | | |
|---|---|---|---|
| 1,910,486 | 5/1933 | Wagner | 165/173 |
| 3,324,942 | 6/1967 | Miller | 165/158 |
| 3,406,752 | 10/1968 | Lion | 165/173 |
| 3,561,524 | 2/1971 | Satterthwaite | 165/76 |
| 3,885,936 | 5/1975 | Limebeer | 165/172 |
| 3,981,354 | 9/1976 | Haberski | 165/175 |
| 4,036,289 | 7/1977 | Cheng et al. | 165/76 |
| 4,040,476 | 8/1977 | Telle et al. | 165/76 |
| 4,475,586 | 10/1984 | Grieb et al. . | |

FOREIGN PATENT DOCUMENTS

| | | | |
|---|---|---|---|
| 513844 | 3/1928 | Fed. Rep. of Germany | 165/173 |
| 1261905 | 1/1972 | United Kingdom | 165/173 |
| 1408823 | 3/1973 | United Kingdom . | |
| 2015146 | 9/1979 | United Kingdom | 165/158 |
| 339753 | 7/1972 | U.S.S.R. | 165/76 |

*Primary Examiner*—Albert W. Davis, Jr.
*Assistant Examiner*—John K. Ford

[57] ABSTRACT

A heat exchanger collector comprising a plurality of connecting tubes, where sets of connecting tubes arranged side by side in a plane are superimposed in layers one on the other for an interlocked connection with mating profile elements inserted in the tube end area. In order to produce a closed wall of the collector, the connecting areas between the tube ends and the mated elements are joined together by, e.g., brazing to prevent the ingress of fluids. The sealed joint to exclude liquids can be achieved also successively in the layer-by-layer construction. The profile elements have recesses for the tubes and further blind recesses for flexibility and thermal effects.

11 Claims, 10 Drawing Figures

TUBULAR DISTRIBUTOR ARRANGEMENT FOR A HEAT COLLECTOR VESSEL

FIELD OF THE INVENTION

This invention relates to a tubular distributor arrangement, especially a heat exchanger collector vessel with connecting tubes.

PRIOR ART

Current practice in the art is to manufacture a tubular distributor systems with a central collector vessel of tubular shape in which the tubes are inserted into the wall of the collector vessel. The vessel is provided with ports in which the tubes are inserted whereafter the tubes and vessel are connected by a bonding process, for example, brazing to provide a passage from the collector vessel to the interior of the tubes. The ports in the collector vessel wall are formed by drilling or by an eroding process before the tubes are inserted, which is an expensive perforating process. The individual attachment of the tubes, especially their insertion, is a relatively elaborate procedure, particularly because the clearance between each tube and the associated port in the wall is small to provide a snug sliding fit. Close tolerances of the port and tube dimensions are necessary in order to obtain a proper brazed connection.

SUMMARY OF THE INVENTION

In a broad aspect the present invention provides a tubular collector vessel arrangement of the aforesaid type which eliminates its disadvantages and enables simple, problem-free and rapid assembly of connecting tubes to a collector vessel.

It is a particular object of the present invention to provide an arrangement in which several tube sets, each of which is formed by a plurality of tubes arranged essentially in a plane, are arranged in spaced layers in a selected position, where in each arrangement of a tube set, preprofiled straight, bent or annular elements are superimposed in the area of one of the tube ends, vertically or at an angle, with the tubes in essentially interlocking arrangement, the elements being connected to the tube ends and to each other to prevent the entry of fluids.

In a further aspect of the present invention, an advantage is provided if, after a tube set and a subsequent preprofiled element have been stacked, the connecting area is sealed, preferably by a bonding process to prevent the entry of fluids, so that a layer-by-layer construction is achieved which results in the stable formation of a wall of a collector vessel.

In an alternative aspect of the present invention, all tube sets and preprofiled elements are arranged in place before all connecting areas are sealed to prevent the ingress of fluids. In this manner the tubular distributor arrangement can compose the structure and, if necessary, it can be corrected in its position before a suitable joining process is used to permanently join the individual parts to prevent the entry of fluids and achieve static stability. The manufacture of a single tubular distributor system, therefore, obviously requires only a single joining operation, which again simplifies manufacture.

The individual straight, bent or annular elements are suitably preprofiled by a suitable method such that with the aid of two successively stacked elements, receiving ports for the individual tubes are produced. Each individual preprofiled contour, therefore, has an open contour with recesses or scallops to suit the configuration of the outer diameter of the tubes. Suitable precise deforming methods for this purpose could be, for example, coining, stamping, rolling and the like.

In an alternative aspect of the present invention, the elements can be preprofiled by other processes, especially by machining processes such as planing, milling and grinding. The inventive concept also embraces erosive processes for this purpose.

When being preprofiled, the elements also can be advantageously provided with webs, dimples, centering or aligning surface structures. They also can be formed with surface structures to assist in the joining processes.

The elements can be provided with rear recesses arranged outside the profiled surface. Recesses of this type produce regions of adapted stiffness and/or thermal expansion when the parts are joined together.

The aforesaid recesses can be provided both in that area of each of the elements which encloses the tube sets and in portions of the elements outside that area to adapt the structural rigidity of the collector vessel formed by the elements to the requirements of service loads generally and locally.

The joining and bonding of the preprofiled element when forming the assembly can be achieved in various ways. Joining the parts together to prevent the entry of fluids by pressure welding can be achieved in the absence or presence of filler material. For the purpose, surface contours can be used to center the parts, and these may become effective to assist the welding process also when electrical resistance welding is used. The various tubes can also be held in position by the preprofiled elements, using a clamping action, before the individual parts are joined together to prevent the entry of fluids.

Another joining method could be, more particularly, diffusion bonding or brazing.

In order to arrange the various tube sets in the intended stable manner, use can advantageously be made of additional spacer elements in the area or spacing of the one tube ends of a tube set. The spacer elements serve to space two tube sets apart when they lie on one another.

The arranging of the various tube sets of the preprofiled elements and conceivably of the spacer elements can be automated, as can the joining of the various tube sets to the preprofiled elements to prevent the entry of fluids. This again simplifies and economizes the manufacture of a tubular distributor system.

A tubular distributor arrangement manufactured in accordance with the present invention, particularly a heat exchanger vessel, is characterized in that the wall of the vessel is formed by tube sets of tubular cross-section or by straight, bent or annular elements of open, preprofiled contours enclosing the tube ends, where the connecting areas are sealed to prevent the entry of fluids.

In accordance with the present invention, therefore, an array of tubes is inserted into the tube sheet of a collector vessel or tube such that the structure is complemented in layers by adding strips or ring-shaped elements, where the tubes associated with the respective layer are simultaneously included in each of the successive steps. This produces an essentially closed vessel wall. The connecting or joining areas are sealed to prevent entry of fluids and to give static stability. The elaborate assembly of individual tubes and the insertion of individual tubes, as is the practice in the present state of the art, is obviated, for the preprofiled contour of each element has open recesses or depressions into which a tube set can be inserted, while it is the preprofiled contour of a subsequent element which encloses the tube set so arranged. The layers may extend vertically or at an inclination lengthwise of the collector vessel. The resistance of forces resulting from internal pressure and temperature is preferably effected in the longitudinal direction of the layers. Depending on their shape (planar or following the curvature of a surface of the collector vessel) the strips or elements can resist the load by bending and/or tangential forces.

BRIEF DESCRIPTION OF THE FIGURES OF THE DRAWING

The invention is described more fully with reference to several embodiments illustrated in the accompanying drawing, in which.

DETAILED DESCRIPTION

Figure 1:
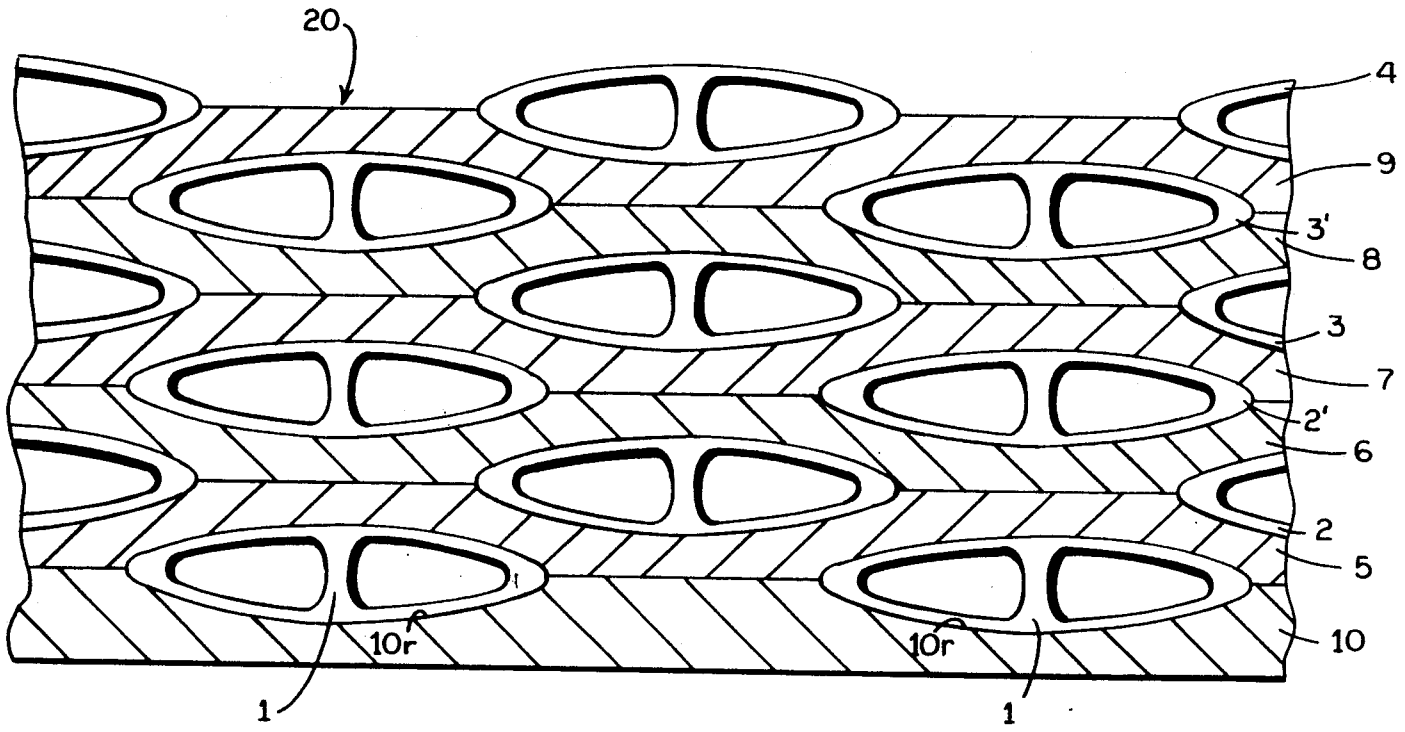
FIG. 1 is an elevational view, from the interior of a collector vessel, of a wall of the vessel having connecting tubes in a stratified arrangement.
Figure 2:
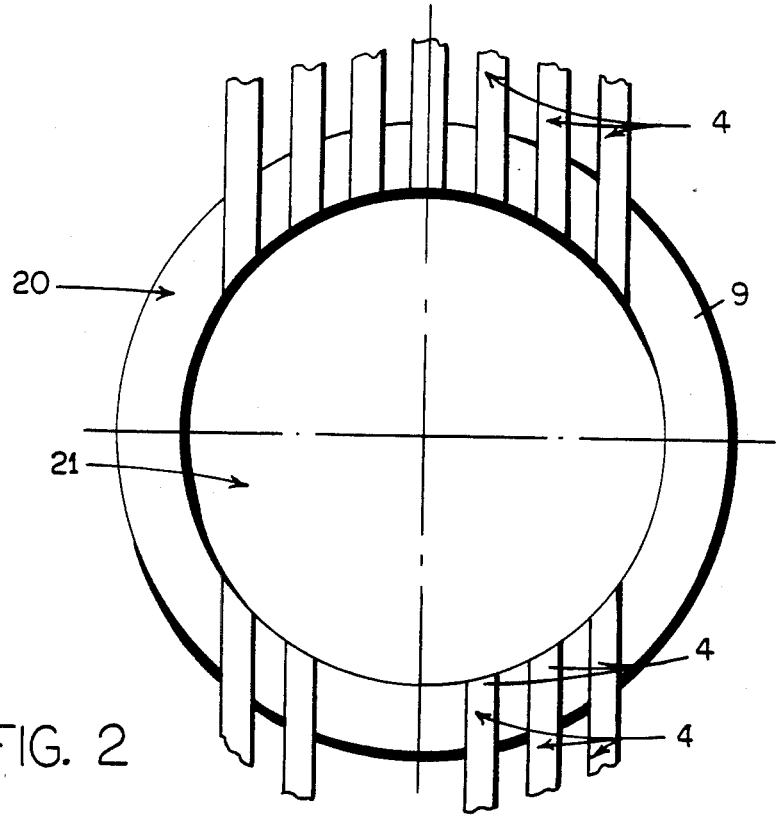
FIG. 2 is a schematic plan view of a partly finished, essentially circular collector vessel having connecting tubes in diametrically opposite arrangement.
Figure 3:
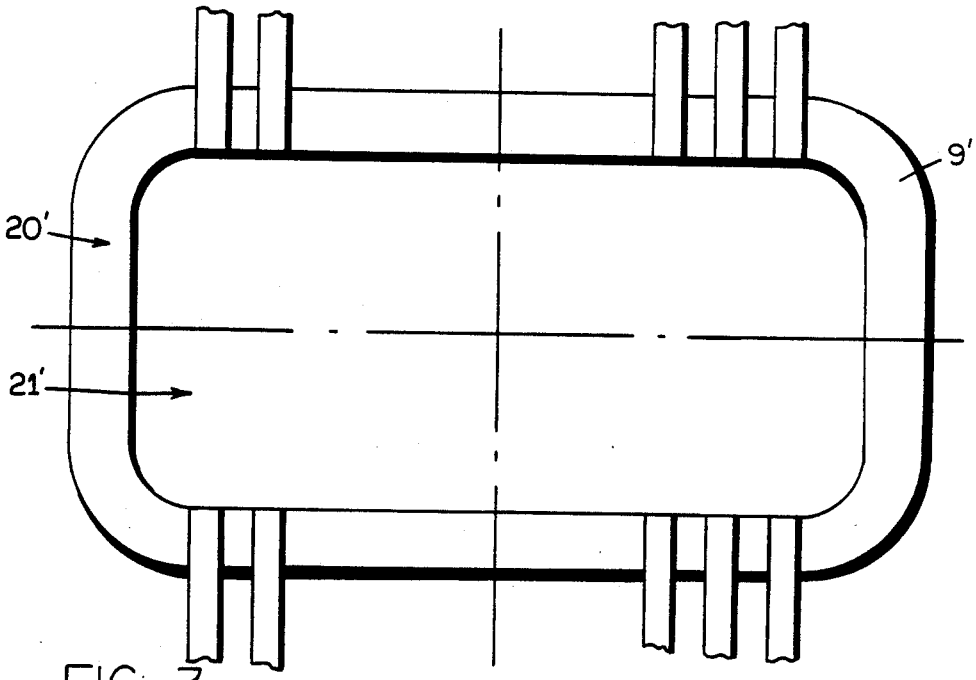
FIG. 3 is a view similar to that of FIG. 2 of a partly finished collector vessel of essentially rectangular cross-section.

A collector vessel wall is schematically illustrated in FIG. 1 and comprises an essentially horizontally extending connecting strip 10 which, as shown in FIG. 2, may be circular or, as shown in FIG. 3, essentially rectangular in shape.

The connecting strip 10 has preprofiled recesses 10*r* at its upper surface for the simultaneous insertion, from above, of the tube ends of a first, essentially horizontally extending tube set 1. Upon insertion of the ends of the tubes of a first tube set 1, a first preprofiled element 5 is superimposed, which also has a circular shape adapted to the diameter of the connecting member 10.

In the same manner, the tube sets 2, 2', 3,3' and 4 are successively inserted after the respective insertion of preprofiled circular element 5, 6, 7, 8 and 9 as evident from FIGS. 1–3, the pre-profiled elements have substantially identical plan form and when superimposed on one another this produces an inner wall of an essentially closed collector vessel. The joining areas between the tubes and the elements are suitably sealed to prevent entry of fluids and to provide static stability, for example, by pressure welding with or without filler material, diffusion bonding or brazing.

The joining process for the assemblies, therefore, is performed package-fashion and can be automated, where spacer elements, if needed, can similarly be added between layers.

FIGS. 2 and 3 are plan views of partially completed collector vessels with tubes in schematic arrangement. The wall 20 of the collector vessel 21 is circular in the embodiment of FIG. 2 and the wall 20' of collector vessel 21' is rectangular in the embodiment of FIG. 3. In both embodiments the wall forms a hollow closed body with an internal chamber which communicates with the tubes which extend through the wall.

Figure 4:
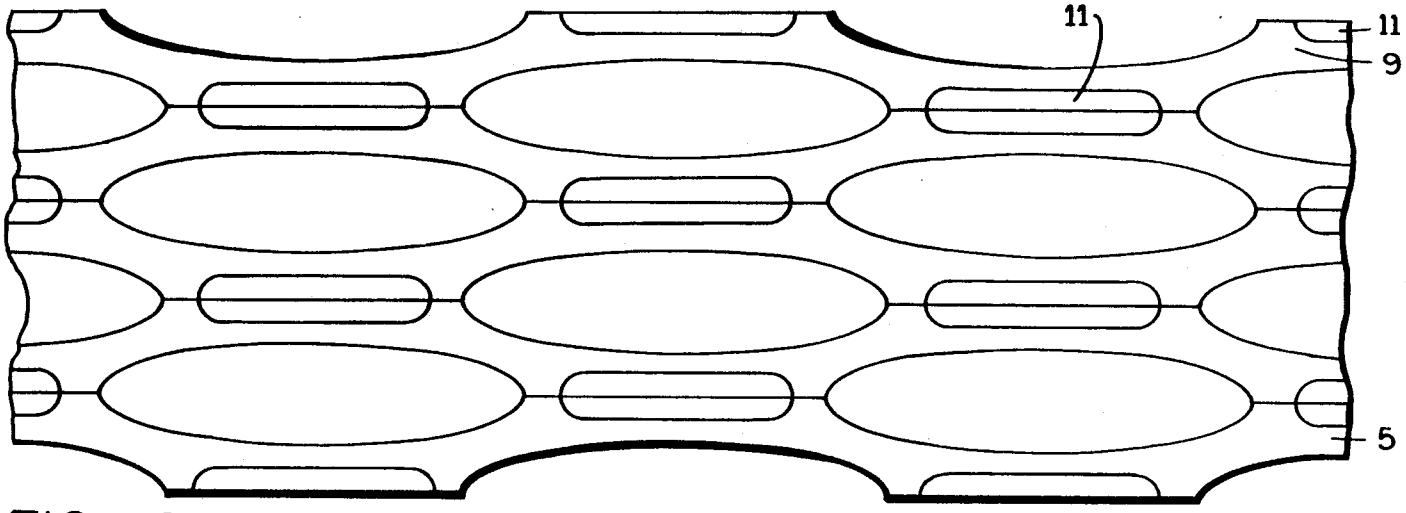
FIG. 4 is a schematic elevational view, similar to that in FIG. 1, but viewed from the exterior to show where the various preprofiled elements have additional recesses outside the actual preprofiled contour to give suitable rigidity to the arrangement.
Figure 5:
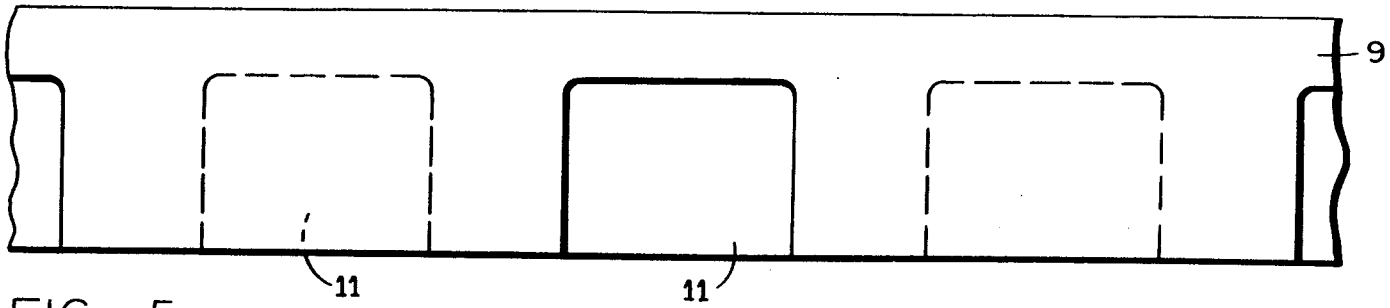
FIG. 5 is a plan view of an element in FIG. 4, FIGS. 6*a* and 6*b* illustrate respective embodiments of profiled contours of successive preprofiled elements to obtain favorable joining and centering conditions.

The inner surface of the wall of the collector vessel shown in the embodiment of FIG. 4 essentially corresponds to the structure of the wall of FIG. 1, and rear recesses 11 are additionally provided outside the actual preprofiled contour of the elements which receive the individual tubes of a tube set. The recesses 11 extend partially through each preprofiled element as seen in FIG. 5 and the recesses 11 of superimposed elements come into registry with one another as seen in FIG. 4 to form blind openings which produce regions of adapted rigidity while still providing a closed inner surface of the wall of the collector vessel whereas the blind openings are open at the outer surface of the wall as seen in FIG. 5.

Figure 6A:
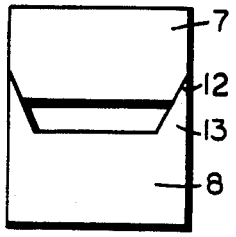
Figure 6B:
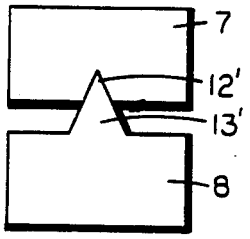

The individual preprofiled elements can be of different cross-sections to provide favorable joining areas between the parts to be assembled. As shown in FIGS. 6*a* and 6*b*, the joining areas may be provided with special surface structure 12,13 and 12',13' to assist the centering of the superimposed elements 7 and 8.

Figure 7:
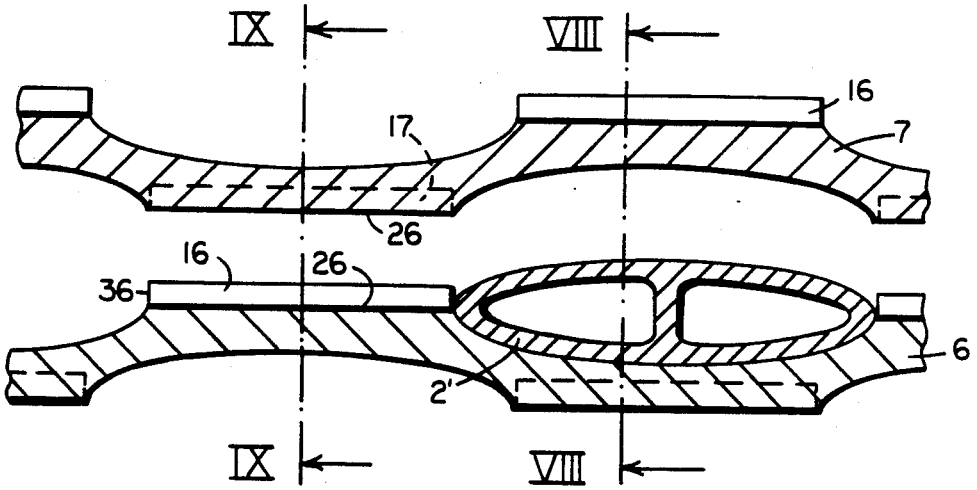
FIG. 7 illustrates two elements in readiness for superimposition, having alternative joining and centering provisions between the tube and the element to keep the tube of a tube set in position before the elements are joined together to prevent the entry of fluids.
Figure 8:
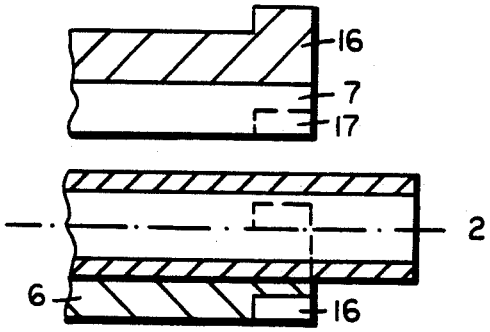
FIG. 8 is a sectional view taken on line VIII—VIII in FIG. 7.
Figure 9:
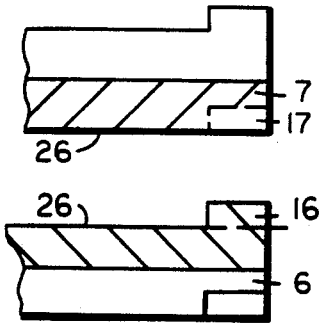
FIG. 9 is a sectional view taken on line IX—IX in FIG. 7.

The joined connection shown in FIG. 7 of a tube 2' to a preprofiled element 6 comprises guide strips 16 projecting beyond the joint surface 26 of the element 6. Because of the guide strips, the tubes of the tube set 2' are safely positioned in the preprofiled recesses of the element 6 before the next element 7 is superimposed from above. In this manner, damage to the tubes 2' by squeezing it between the joint surfaces is prevented. The contour of the guide strips 16 or of corresponding guide recesses 17 of the element 7 will be evident from the cross-sections of FIGS. 8 and 9.

The side edges 36 of the guide strips 16 can be crowned or conical so that the tube 2' will be inserted by snap effect into the preprofiled recesses of the element 6.

As seen from the above, the invention provides a method of manufacturing a heat exchanger collector with connecting tubes by successively mounting in superimposed relation on one another, a plurality of preprofiled elements 5–10 and mounting the ends of a plurality of tubes 1–4 on each element before the next element is superimposed thereon such that when the next element is superimposed on the previous element, it becomes interlocked therewith with the ends of the tubes sandwiched therebetween essentially in a common plane in apertures formed by the superimposed recesses. Thereafter, the elements are connected to the tube ends and to each other to prevent entry of fluids therebetween.

The arrangement shown in FIGS. 6*a*, 6*b* and 7–9 are especially useful insofar that the successive elements can be guidably interlocked.

Although the invention has been described in relation to specific embodiments thereof, it will become evident to those skilled in the art that numerous modifications and variations can be made within the scope and spirit of the invention as defined in the attached claims.

What is claimed is:

1. A tubular distributor comprising a hollow collector vessel including a wall defining an internal chamber, a plurality of tubes extending through said wall into communication with said chamber, said wall comprising a plurality of pre-profiled elements of substantially identical plan form mounted in superimposed relation on one another to collectively form said wall, each pre-profiled element having upper and lower surfaces and opposite end surfaces, the elements being superimposed with the lower element to form superimposed surfaces in successive substantially common planes, said elements having first recesses in said upper and lower surfaces which respectively and cooperatively form apertures for said tubes when said elements are superimposed on one another, said recesses in the upper and lower surfaces of each element being respectively offset from one another and respectively receiving one-half of the cross-section of corresponding tubes, and means at the adjoining surfaces of said elements with one another and with said tubes for preventing entry of fluids therebetween, said upper and lower surfaces of said pre-profiled elements being provided with second recesses, said second recesses extending from a first one end surface of each element partially through said element towards the other of said end surfaces such that when said elements are superimposed the second recesses of superimposed elements come into registry and form bling openings which open externally of said wall at said first one end surface of said elements.

2. A tubular distributor as claimed in claim 1 wherein said second recesses are respectively provided in the upper and lower surfaces of each pre-profiled element opposite said first recesses.

3. A tubular distributor as claimed in claim 1 wherein said means for preventing entry of fluids compirses bonding means at said adjoining surfaces.

4. A tubular distributor as claimed in claim 1 wherein said means for preventing entry of fluids comprises pressure weld connections at said adjoining surfaces.

5. A tubular distributor as claimed in claim 1 wherein said means for preventing entry of fluids comprises diffusion bond connections at said adjoining surfaces.

6. A tubular distributor as claimed in claim 1 wherein said means for preventing entry of fluids comprises brazed connections at said adjoining surfaces.

7. A tubular distributor as claimed in claim 1 wherein said pre-profiled elements are of rectangular plan form.

8. A tubular distributor as claimed in claim 1 further comprising means on said pre-profiled elements for guidably interlocking the elements in superimposed relation.

9. A tubular distributor as claimed in claim 1 wherein the end surfaces of each said element are inner and outer surfaces, said first one end surface being the outer surface of said element.

10. A distributor as claimed in claim 1 wherein said pre-profiled elements are of annular plan form.

11. A distributor as claimed in claim 1 wherein each of said second recesses is opposite a respective first recess in the opposite surfaces of said elements.

* * * * *

UNITED STATES PATENT AND TRADEMARK OFFICE

CERTIFICATE OF CORRECTION

PATENT NO. : 4,597,436

DATED : July 1, 1986

INVENTOR(S) : Hagemeister, et al

It is certified that error appears in the above-identified patent and that said Letters Patent is hereby corrected as shown below:

On the title page assignee should read

--(73)Assignee: Motoren-Und Turbinen-Union Muchen GmbH --.

Signed and Sealed this

Eighth Day of December, 1987

*Attest:*

DONALD J. QUIGG

*Attesting Officer*

*Commissioner of Patents and Trademarks*